US005575694A

United States Patent [19]

Hawkins et al.

[11] Patent Number: 5,575,694

[45] Date of Patent: Nov. 19, 1996

[54] ELECTRICAL CONNECTOR FOR ATTACHMENT TO A MEDICAL DEVICE

[75] Inventors: H. Gene Hawkins, Spencer; Vincent J. Testa, Bloomington; Randall L. Hacker, Martinsville, all of Ind.

[73] Assignee: Boston Scientific Corporation, Natick, Mass.

[21] Appl. No.: 425,085

[22] Filed: Apr. 19, 1995

[51] Int. Cl.[6] ..... H01R 4/28

[52] U.S. Cl. ..... 439/825; 439/218

[58] Field of Search ..... 439/825, 818, 439/217, 222, 223

[56] References Cited

U.S. PATENT DOCUMENTS

| | | | |
|---|---|---|---|
| 3,065,450 | 11/1962 | Fieberg | 439/825 |
| 3,675,189 | 7/1972 | Smith | 439/825 |
| 3,693,140 | 9/1972 | Nijman | 439/825 |
| 4,405,195 | 9/1983 | Cherry et al. | 439/825 |
| 4,526,429 | 7/1985 | Kirkman | 439/825 |
| 5,066,242 | 11/1991 | Martucci | 439/825 |

*Primary Examiner*—Stephen P. Garbe

[57] ABSTRACT

An electrical connector (1) for attachment to a medical device. The connector includes a shaft of electrically conductive material having a proximal end (2) and a distal end (3). Screw threads (4) are disposed on the proximal end of the shaft for attachment of the connector (1) to the device. A longitudinally extending slot (6) extends from the distal end of the connector and forms two legs (7*a*) and (7*b*). A pair of shoulders (8*a*) and (8*b*) extend from the middle of the connector. The shoulders are adapted to engage internal walls of one type of a female connector. A circumferentially extending recess (9*a*) and (9*b*) is disposed adjacent the distal end of the connector. The recess forms a head disposed distally of the recess. The recess is adapted to engage a ring disposed within another type of female socket. The legs are displaceable such that they provide spring engagement of the connector within the female connector by either the circumferentially extending recess or by the shoulders.

2 Claims, 2 Drawing Sheets

ELECTRICAL CONNECTOR FOR ATTACHMENT TO A MEDICAL DEVICE

FIELD OF THE INVENTION

The present invention relates to electrical connectors for attachment to medical devices and especially a dual function male electrical connector for attachment to a cautery connector for endoscopy, especially endoscopic snares.

SUMMARY OF THE PRIOR ART

Electrical connectors for cautery endoscopic snares are well known to the art. Such connectors, however, are not readily usable with power supplies from different manufacturers. Since operating rooms use power supplies manufactured by different manufacturers, and these different manufacturers use female connectors of different constructions, it has been necessary for manufacturers of endoscopic devices to stock and maintain male connectors which are suitable for each of the power supplies currently on the market. For example, with one of the manufacturers, the female connectors require male connectors which have shoulders about their midpoints to engage the interior surface of the female connector and provide an electrical connection. With another manufacturer, the female connector requires a male connector having a circumferentially extending recess disposed adjacent the distal end of the connector. In this latter case, the recess in the male connector engages a ring within the female connector. Both of the connectors provide resilient electrical and mechanical contact with the inner surface of the female connector.

SUMMARY OF THE INVENTION

According to the present invention we have discovered an electrical connector for attachment to a medical device. The connector includes a shaft of electrically conductive material having a proximal end and a distal end. A screw thread and hex nut is disposed on the proximal end of the shaft for attachment of the connector to the medical device. An elongated, longitudinal slot extends from the distal end of the connector to provide it with two legs. The slot is between about 0.015 and 0.050 inches wide. The legs are splayed outwardly somewhat at their distal end to make them urge against the female socket to provide spring-action engagement. At least two shoulders are disposed in the middle of the connector on each of the legs. The shoulders are arranged to engage the inner surface of the female connector to provide both frictional engagement and electrical connection. A circumferentially extending recess is disposed adjacent the distal end of the connector thus forming a head (separated into halves by the slot) on the distal end of the connector. The recess is adapted to receive a ring is disposed within the female socket. Thus, irrespective of the female socket to be attached to the connector, efficient mechanical and electrical contact can be made.

DESCRIPTION OF THE PREFERRED EMBODIMENTS

Figure 1:
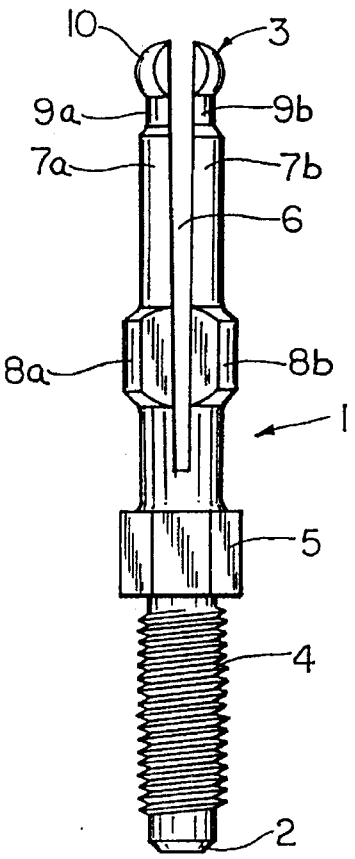
FIG. 1 is a side elevational view of the electrical connector for attachment to a medical device of the present invention.

Referring now to FIG. 1, the electrical connector 1 of the present invention is formed of a brass shaft having a proximal end 2 and a distal end 3. The proximal end 2 has conventional threads 4 disposed thereon for securing the connector into the medical device. A conventional hex nut 5 is formed between the ends of the threads 4 and the body of the connector 1 for attaching the connector to the medical device. The distal end of the connector has a diametrically extending, longitudinal slot 6 formed in it. The slot is between about 0.015 and 0.050 inches wide and extends from the distal end of connector 1 to adjacent the hex nut 5. The slot forms two legs **7*a* and 7*b* in the connector 1**. Normally these legs are splayed apart and when squeezed together during use they exert a force against the insides of the female connector in which it is fitted.

A pair of shoulders **8*a* and 8*b* are disposed at about the middle of the connector 1. The shoulders 8*a* and 8*b* will be used to establish mechanical and electrical connections as will be explained later. A circumferentially extending recess 9*a* and 9*b* is disposed adjacent the distal end of the connector 1. The tip of the connector 1 is formed as a head 10, split by the slot 6**.

Figure 2:
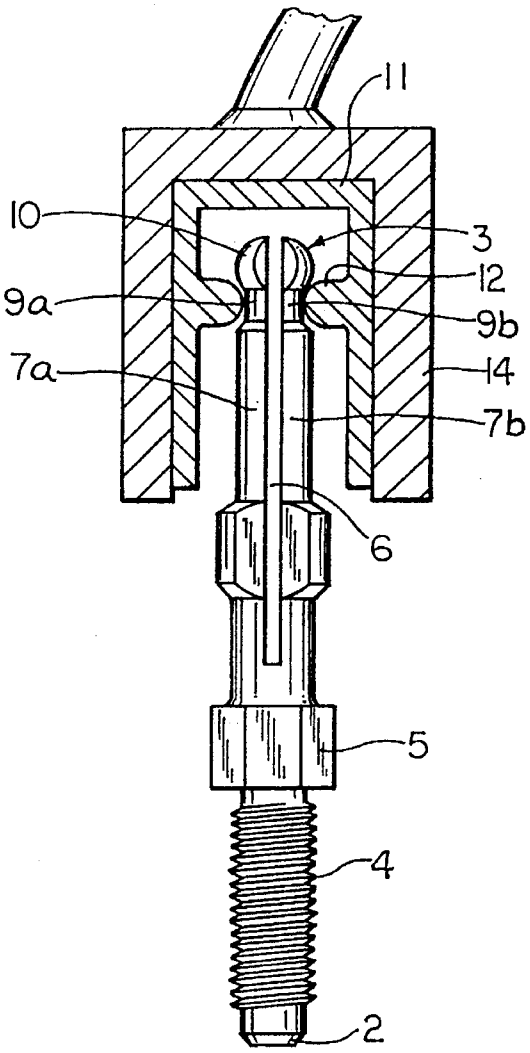
FIG. 2 is a side elevational view, partially in cross-section, the electrical connector shown in FIG. 1 disposed in one type of female connector.

Referring now to FIG. 2 the connector of the present invention is shown disposed in one type of female socket. As shown, the female connector includes an electrically conductive material 11 disposed within an electrically insulated cover 14. An internal ring 12 formed of the same material as the connector material 11 is disposed within the female connector. When the distal end 3 of connector is squeezed into the ring 12, the legs **7*a* and 7*b* will squeeze together to allow entrance of the head 10. When inside, the recesses 9*a* and 9*b* engage the ring 12 and hold the connector 1** in place.

Figure 3:
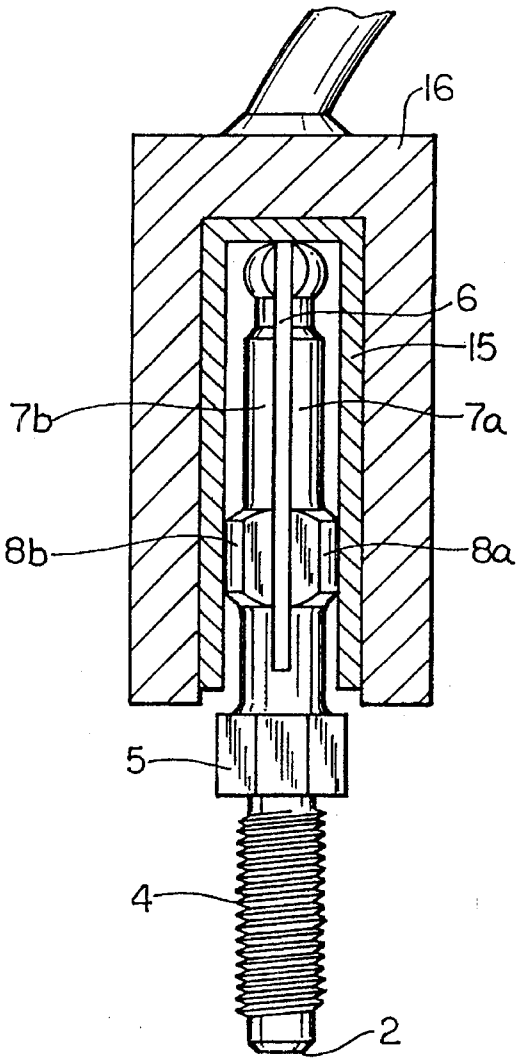
FIG. 3 is a side elevational view, partially in cross-section, of the electrical connector of the present invention disposed in another type of female connector.
Figure 4:
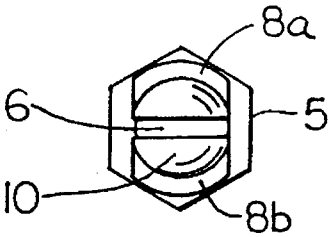
FIG. 4 is a top plan view of the electrical connector shown in FIG. 1.

Referring now to FIG. 3, the male connector shown disposed within a different type of female connector. In this Figure the shoulders **8*a* and 8*b* engage an electrically conductive surface 15. Surface 15 is generally cylindrical in cross-section and is disposed within an insulating cover 16. Again, the legs 7*a* and 7*b* provide the resiliency for shoulders 8*a* and 8*b* to engage the interior of the electrically conductive surface 15. In FIG. 4 the slot 6 can be seen disposed between halves of the head 10. Shoulders 8*a* and 8*b* extend from the side of the connector. The hex nut 5 is disposed beneath shoulders 8*a* and 8*b***.

Figure 5:
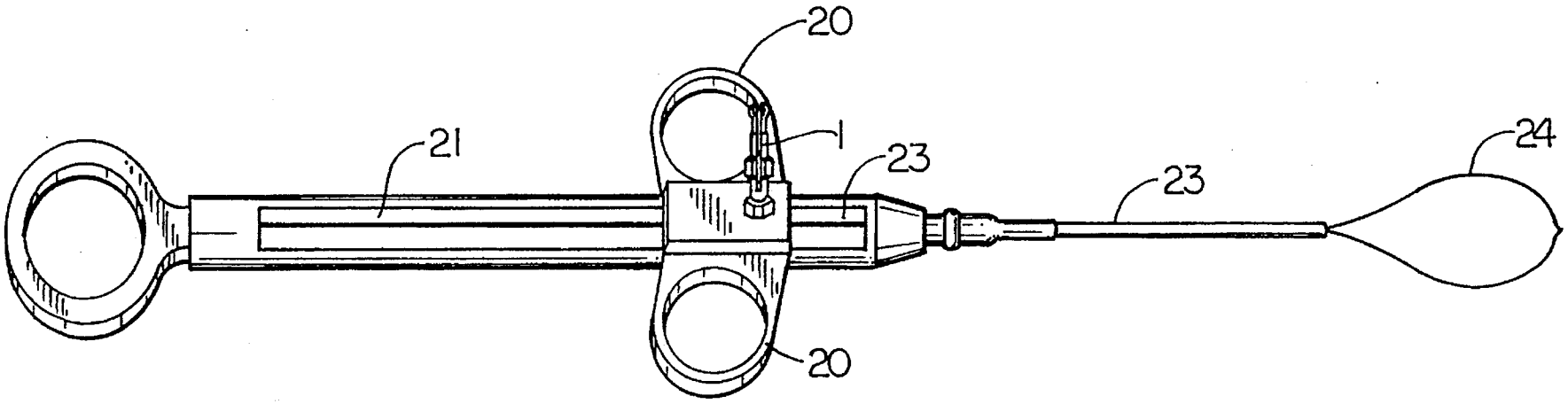
FIG. 5 is a perspective view of electrical connector of the present invention attached to a cautery polypectomy snare.

Referring to FIG. 5, the electrical connector of the present invention is shown attached to a cauterizing endoscopic snare. The snare is of a conventional design and includes a pair of finger grips 20 which ride in a track 21 to control a snare 24 disposed within and extending from a sheath 23. The electrical connector 1 is shown mounted on the finger grips 20. When the snare 24 is disposed about a polyp, the finger grips can be retracted and the snare 24 will strangle the polyp and then cauterized the wound with an electrical charge. The snare 24 is electrically connected to connector 1.

It is apparent that changes and modifications may be made within the spirit and scope of the present invention, but it is our intention, however, only to be limited by the scope of the following claims.

As our invention we claim:

1. An electrical connector for attachment to a medical device, said connector comprising:

a shaft of electrically conductive material having a proximal end, a distal end and threads disposed on said proximal end;

a longitudinally extending slot extending from the distal end of said connector, said slot forming two legs of said connector;

a hex nut disposed between said proximal end and said longitudinally extending slot;

electrical engaging means extending from the middle of said connector, said means being formed of at least two shoulders extending from the legs of said connector, said shoulders being adapted to engage internal walls of a female connector;

a circumferentially extending recess disposed adjacent the distal end of said connector, said recess forming a head disposed distally of said recess, said recess being adapted to engage a ring disposed within the female connector;

said legs being displaceable such that said legs provide a spring engagement of said connector with the female connector by either said circumferentially extending recess or by said shoulders.

2. The connector according to claim 1 wherein said legs are splayed outwardly from each other to improve mechanical and electrical connection between said connector and the female socket.

* * * * *